US009903101B2

(12) United States Patent
Serrurier et al.

(10) Patent No.: US 9,903,101 B2
(45) Date of Patent: Feb. 27, 2018

(54) REPLACEABLE SHROUD FOR WORK IMPLEMENT

(71) Applicant: Caterpillar Inc., Peoria, IL (US)

(72) Inventors: Douglas Serrurier, Morton, IL (US); Madhukar Maguluru, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 210 days.

(21) Appl. No.: 14/879,292

(22) Filed: Oct. 9, 2015

(65) Prior Publication Data

US 2016/0160476 A1 Jun. 9, 2016

Related U.S. Application Data

(60) Provisional application No. 62/088,171, filed on Dec. 5, 2014.

(51) Int. Cl.
*E02F 9/28* (2006.01)

(52) U.S. Cl.
CPC ..... *E02F 9/2883* (2013.01); *E02F 9/2825* (2013.01); *E02F 9/2833* (2013.01); *E02F 9/2858* (2013.01); *E02F 9/2891* (2013.01)

(58) Field of Classification Search
CPC ..... E02F 9/2883; E02F 9/2825; E02F 9/2833; E02F 9/2858; E02F 9/2891; E21C 35/18
See application file for complete search history.

(56) References Cited

U.S. PATENT DOCUMENTS 3,621,594 A * 11/1971 Hahn et al. ..... E02F 9/2808 37/451
3,851,413 A 12/1974 Lukavich
3,995,384 A * 12/1976 Wood ..... E02F 3/40 172/719
4,748,754 A 6/1988 Schwappach
5,088,214 A * 2/1992 Jones ..... E02F 9/2883 172/772.5
5,526,592 A * 6/1996 Bierwith ..... E02F 9/2883 172/772.5
5,666,748 A 9/1997 Emrich et al.
7,275,338 B2 10/2007 LaHood
7,526,886 B2 * 5/2009 McClanahan ..... E02F 9/2841 37/450

(Continued)

FOREIGN PATENT DOCUMENTS

JP 2001-295315 10/2001

OTHER PUBLICATIONS http://www.escocorp.com/EN/products/Pages/toplok-shroud.aspx, "Toplok® Shrouds"© 2014 ESCO Corporation.

*Primary Examiner* — Jamie L McGowan
(74) *Attorney, Agent, or Firm* — Finnegan, Henderson, Farabow, Garrett & Dunner, LLP

(57) ABSTRACT

A side shroud may have an elongated body configured to straddle an edge of the work implement, and a mounting portion extending from a side of the elongated body. The mounting portion may include a back defining an opening, a first side connected to the back, and a second side connected to the back opposite the first side. The mounting portion may also include at least one tab extending inwardly from the back of the mounting portion at a location adjacent the opening and between the first and second sides. The at least one tab may be configured to removably couple the shroud to a mounting base attached to the work implement.

5 Claims, 3 Drawing Sheets

(56) References Cited

U.S. PATENT DOCUMENTS

| | | | | |
|---|---|---|---|---|
| 7,793,444 | B2 * | 9/2010 | Jones | E02F 9/2825 37/453 |
| 8,024,874 | B2 * | 9/2011 | McClanahan | E02F 9/2883 37/446 |
| D676,067 | S * | 2/2013 | Attwood | D15/28 |
| D769,945 | S * | 10/2016 | Serrurier | D15/28 |
| D788,826 | S * | 6/2017 | Serrurier | D15/28 |
| 2004/0098887 | A1 | 5/2004 | Livesay | |
| 2005/0120596 | A1 | 6/2005 | Kasim | |
| 2008/0092412 | A1 * | 4/2008 | McClanahan | E02F 9/2883 37/451 |
| 2009/0217556 | A1 * | 9/2009 | McClanahan | E02F 9/2833 37/451 |
| 2015/0121729 | A1 * | 5/2015 | Kunz | E02F 9/2883 37/451 |

* cited by examiner

REPLACEABLE SHROUD FOR WORK IMPLEMENT

RELATED APPLICATIONS

This application is based on and claims priority to U.S. Provisional Application No. 62/088,171 filed on Dec. 5, 2014, the contents of which are expressly incorporated herein by reference.

TECHNICAL FIELD

The present disclosure relates generally to a shroud for a work implement and, more particularly, to a shroud that can be quickly and easily replaced when worn.

BACKGROUND

Earth-working machines, such as wheel loaders, cable shovels, excavators, and front shovels, include implements generally used for digging into, ripping, or otherwise moving earthen material. These implements are subjected to abrasion and impacts that cause them to wear. To prolong the useful life of the implements, various shrouds can be connected to the earth-working implements at areas experiencing the wear. These shrouds are replaceably connected to the implements using a retention system.

An exemplary shroud is disclosed in U.S. Patent Publication 2004/0098887 of Livesay that published on May 27, 2004 ("the '887 publication"). Specifically, the '887 publication discloses a protector for a sidebar of a bucket. The protector has a V-shaped cross-section and extends in a linear direction along an edge of the sidebar. A mounting element having "T" or "dovetail" configuration is welded to the edge of the bucket sidebar, and the protector is then slid into place over the mounting element such that a vertex of the V-shape is oriented away from the mounting element. A fastener passes through the vertex at a lengthwise center of the protector to engage the mounting element, thereby inhibiting undesired sliding of the protector that would decouple the protector from the mounting element.

Although acceptable for some applications, the protector of the '887 publication may not have broad applicability. Specifically, the protector may not be compatible with a bucket having a curved sidebar. In addition, locating the mounting element on the edge of the sidebar may not be sufficiently durable and/or accessible in some instances.

The disclosed shroud is directed to overcoming one or more of the problems set forth above.

SUMMARY

According to one exemplary aspect, the present disclosure is directed to a shroud for use with a work implement. The shroud may include an elongated body configured to straddle an edge of the work implement, and a mounting portion extending from a side of the elongated body. The mounting portion may have a back defining an opening, a first side connected to the back, and a second side connected to the back opposite the first side. The mounting portion may also have at least one tab extending inwardly from the back of the mounting portion at a location adjacent the opening and between the first and second sides. The at least one tab may be configured to removably couple the shroud to a mounting base attached to the work implement.

According to another exemplary aspect, the present disclosure is directed to a side shroud. The side shroud may include an elongated body being arcuate along its length, and having a vertex and spaced apart first and second legs that are connected to the vertex. The side shroud may also include a first protrusion extending inward at a first end of the elongated body, a second protrusion extending inward at a second end of the elongated body, and a mounting portion extending from the first leg. The mounting portion may have be formed from a back, a first side, and a second side. The mounting portion may include a first tab located at a first end of the mounting portion proximate the first leg of the elongated body, a second tab located at a second end of the mounting portion distal from the first leg, and a window formed in the back between the first and second tabs.

According to yet another exemplary aspect, the present disclosure is directed to a side shroud assembly for a work implement having a floor and first and second curved sides connected to the floor. The side shroud assembly may also include a base weldable to an external surface of the first curved side, and a shroud having an elongated body. The elongated body may be arcuate along its length, and have a vertex and spaced apart first and second legs that are connected to the vertex. The shroud may also have a first protrusion extending inward at a first end of the elongated body, a second protrusion extending inward at a second end of the elongated body, and a mounting portion extending from the first leg and having a window. The shroud assembly may further include a locking mechanism configured to pass through the window of the mounting portion and engage the base, thereby locking the shroud to the first curved side of the work implement.

DETAILED DESCRIPTION

Figure 1:
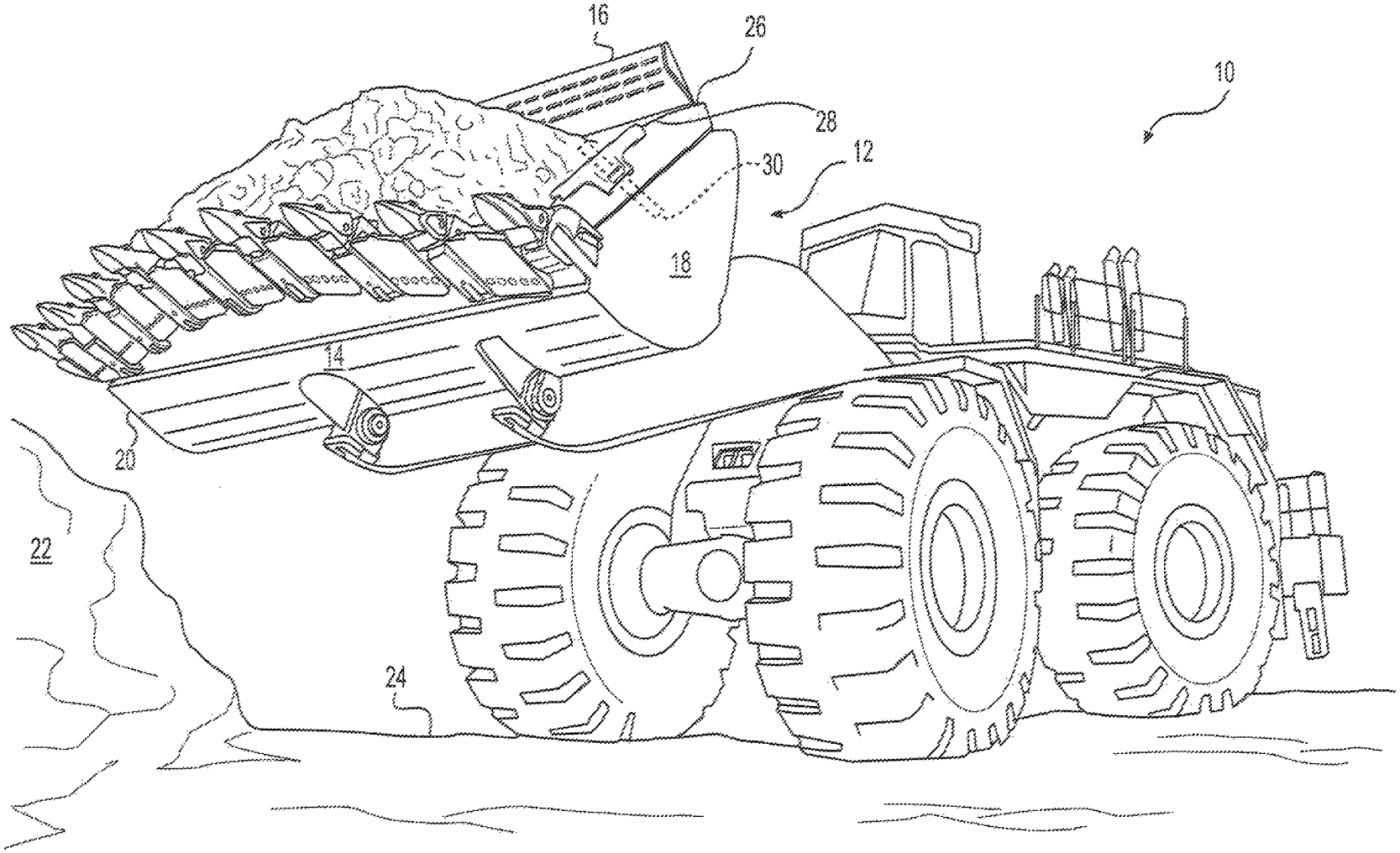
FIG. 1 is an isometric illustration of an exemplary disclosed machine.

FIG. 1 illustrates a mobile machine 10 having a work implement 12 operatively connected at a leading end. In the disclosed embodiment, machine 10 is a wheel loader. It is contemplated, however, that machine 10 may embody any other type of mobile or stationary machine known in the art, for example a skidsteer loader, an excavator, a hydraulic shovel, a dragline, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform the task assigned to machine 10. For example, work implement 12 may be a loading bucket (shown in FIG. 1), a digging bucket, a shovel, or another material moving device known in the art. Regardless of the specific configuration, work implement 12 may have multiple walls that together define a partially enclosed space configured to retain. material therein. Specifically, work implement may include a floor 14, a back or ceiling 16, a left side wall 18, and an opposing right side wall 20. Each of these structural components may be welded to each other to form the enclosed space, and one or more ribs, gussets, fillets, webs, brackets, etc. may be used to provide a desired stiffness, strength, or connection. In some embodiments, one or more of floor 14, back 16, left side wall 18, and right side wall 20 may be integral (e.g., bent to the required shape from a common sheet of material), if desired.

During use of machine 10, work implement 12 may be driven forward into a pile 22 of material, with floor 14 generally parallel with a ground surface 24. The operator may then lift work implement 12, causing additional material to spill into the enclosed space, and begin racking work implement 12 backward to a carry position. When this happens, the material loaded onto the front edge of floor 14 may fall further into work implement 12 and spread towards left and right side walls 18, 20. It has been found that, in some applications, curving an outer edge 26 of left and right side walls 18, 20 outward increases an amount of the spreading material retained inside work implement 12 (i.e., decreases an amount of material that spills over left and right side walls 18, 20). For this reason, outer edges 26 of left and right side walls 18, 20 may be generally convex.

Work implement 12 may be equipped with a shroud 28 that is located at each edge 26 to increase longevity of work implement 12. In particular, during engagement of work implement 12 with pile 22, edges 26 may come into abrasive contact with the material. Unless accounted for, this contact may cause premature wear of edges 26, thereby reducing the effectiveness of the convex shape and the life of work implement 12. Shrouds 28 may be replaceable, and configured to protect edges 26 from wear.

In some embodiments, a length of shroud 28 may be selected so that only a single shroud 28 may be coupled to each of left and right side walls 18, 20. Specifically, a length of shroud 28 may be selected to be just larger than one-half of a length of edge 26. In this way, a machine owner may be inhibited from installing two shrouds 28 in an end-to-end arrangement on each side wall 18, 20.

In general, wear along edge 26 may be greater near floor 14. Specifically, material engaged by work implement 12 may more often be positioned lower along edges 26 due to the effects of gravity and/or the difficulty of always fully loading work implement 12. For this reason, a lower end of shroud 28 may generally experience more wear than an upper end. Shroud 28 may be generally symmetric, relative to a lengthwise center (i.e., relative to a plane of symmetry 30), such that, after a period of wear, the shroud 28 originally mounted to left side wall 18 may be switched with the shroud 28 originally mounted to right side wall 20, thereby increasing a useful life of shrouds 28. In particular, at a time when the lower ends of shrouds 28 are worn out, the positions of shrouds 28 may be switched so that the upper ends thereof that are not nearly so worn may be moved to the lower positions that experience the higher rates of wear.

Figure 2:
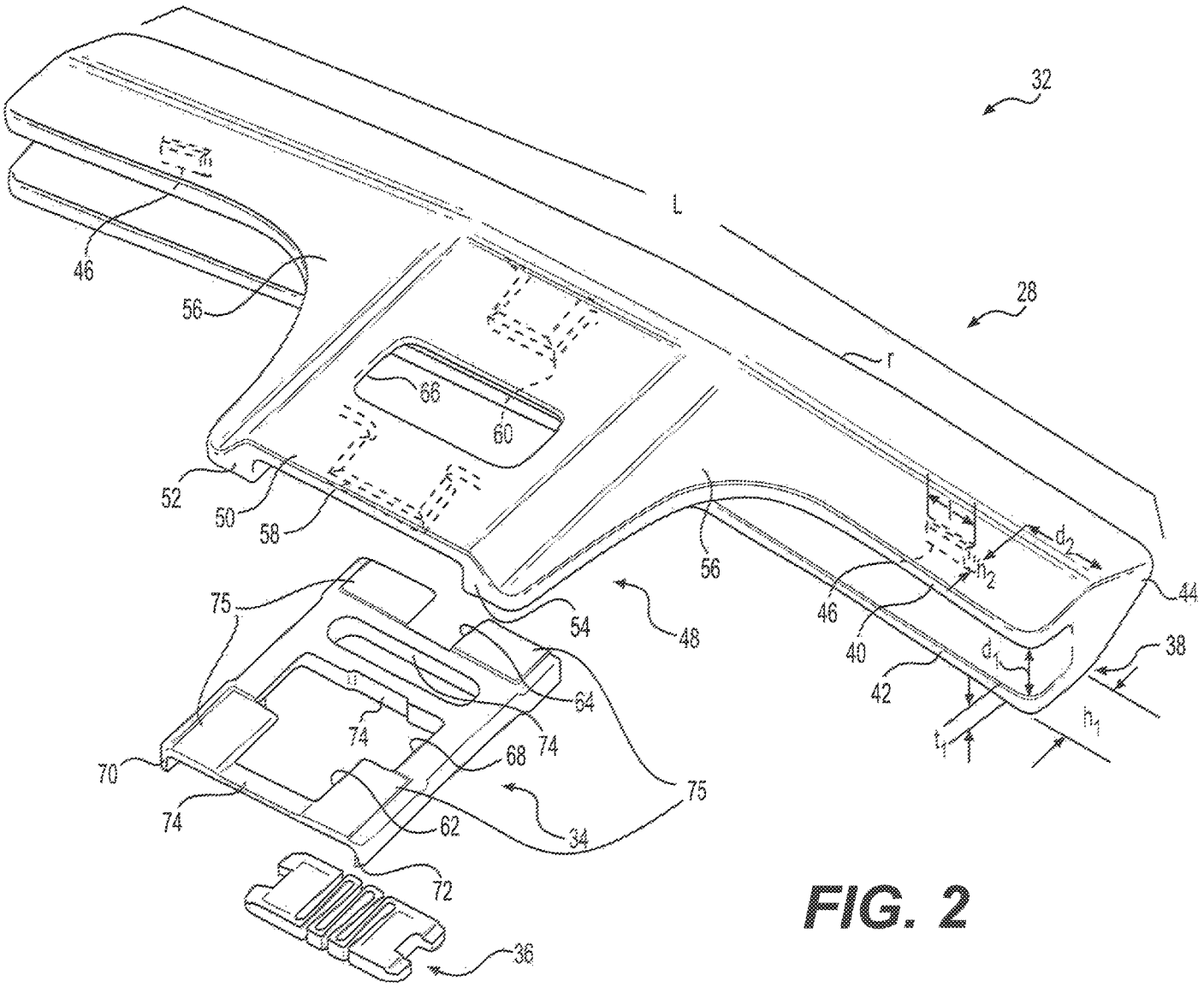
FIG. 2 is an exploded view illustration of a side shroud assembly that may be used in conjunction with the machine of FIG. 1.
Figure 4:
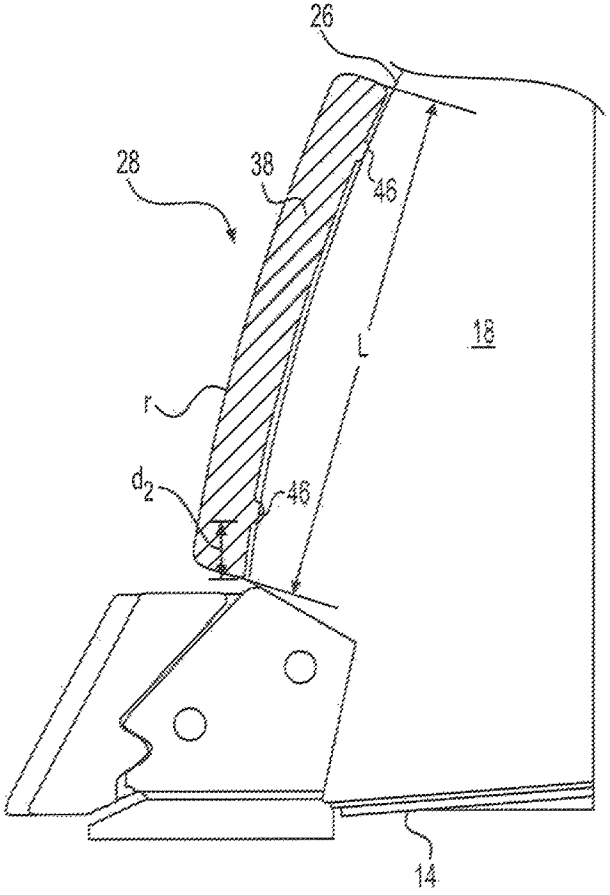
FIG. 4 is a cross-sectional illustration of the side shroud assembly of FIGS. 2 and 3.
Figure 3:
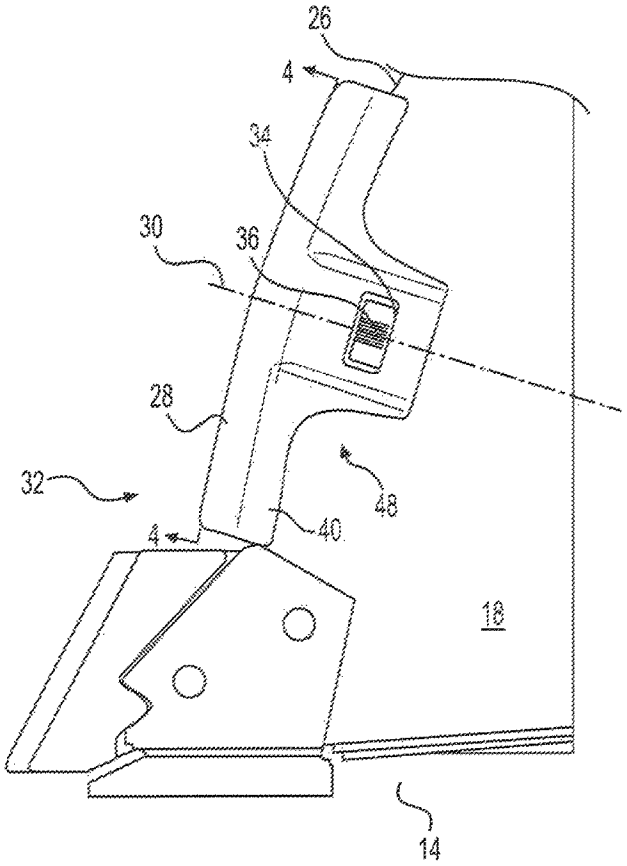
FIG. 3 is a side view illustration of the side shroud assembly of FIG. 2.

As shown in FIGS. 2-4, shroud 28 may be included within a shroud assembly 32 that also includes a base 34 and a retainer 36. Shroud 28 may be configured to slide into engagement with base 34, and retainer 36 may thereafter be used to inhibit undesired removal of shroud 28.

Shroud 28 may be a single integral component fabricated through a casting process from an alloy material (e.g., from steel). Shroud 28 may have an elongated body 38 with a length L and consisting of spaced-apart first and second legs 40, 42 that are connected to each other at a vertex 44 to form a cross-section having a general V-shape. Body 38 may be arcuate, having a radius r of curvature substantially matching the radius of curvature of edge 26 (referring to FIG. 1). Legs 40, 42 may be spaced apart from each other by a distance $d_1$ that allows legs 40, 42 to straddle edge 26 during installation, have a height $h_1$, and a thickness $t_1$. Two protrusions 46 may be formed within the space between legs 40, 42 and configured to engage the outer surface at edge 26. In the disclosed embodiment, protrusions 46 are located a distance $d_2$ away from the ends of body 38 to facilitate the casting process and to account for manufacturing variation during installation, have a length l generally aligned with the length direction of body 38, and a height $h_2$. As shown in FIG. 4, protrusions 46 may extend inward relative to the curvature of body 38, thereby allowing for two-point contact of shroud 28 with edge 26. Protrusions 46 may provide for this two-point contact, even when engaged with curved edges 26 having varying radii, wear, and/or tolerance stackups.

A mounting portion 48 may extend from first leg 40 inward relative to the curvature of body 38. Mounting portion 48 may be generally three-sided structure, with a raised back 50 and first and second ends 52, 54. A fillet 56 may be positioned at an inside corner between first leg 40 and each of first and second ends 52, 54 to increase a rigidity of mounting portion 48. Two tabs or projections 58, 60 may protrude inward from back 50 to engage base 34. In the disclosed embodiment, each of tabs 58, 60 have a dovetail cross section (i.e., a cross-section with opposing diverging side surfaces) such that tabs 58, 60 can be slid into corresponding notches 62, 64 of base 34. It is contemplated, however, that one or both of tabs 58, 60 could alternatively have a T-shaped cross-section or another cross-section, if desired. Tab 60 may be smaller and located closer to first leg 40 than tab 58, and tabs 58 and 60 may be generally aligned with each other and with plane 30 (referring to FIGS. 1 and 3). A window or opening 66 may be formed in back 50 at a location between tabs 58 and 60, and configured to receive retainer 36. After mounting portion 48 is slid into engagement with base 34 and retainer 36 is placed through window 66 into a corresponding recess 68 of base 34, shroud 28 may be inhibited from removal by way of a mechanical interference between retainer 36 and tab 58.

The dimensions of shroud 28 may be selected to ensure adequate strength, security, durability, and longevity. For example, the radius of curvature and length of body 38 may be selected such that a ratio of these values (r/L) is about 2.75-3.0 (e.g., +/−10%). This ratio may provide for a desired engagement of a common shroud 28 with a range of different work implements 12 having different edge lengths and curvatures. In particular, a different curvature formed within a body 38 having a different length could decrease the engagement of shroud 28 with edge 26.

In another example, the height of protrusions 46 and the height of legs 40, 42, may be selected to allow for manufacturing variations of work implement 12 and to provide a desired breakout strength. In particular, $h_2$ may be selected to be about $1/10^{th}$ (e.g., +/−10%) of $h_1$, and the thickness t may be about 2/3 (e.g., +/−10%) of the distance $d_1$. These ratios may facilitate large tolerance stackups, while still providing adequate strength.

In yet another example, the distance d of protrusions 46 from the ends of body 38 may be about equal to 10% (e.g., +/−10%) of the length L. As described above, this relationship may facilitate the casting of shroud 28 while accounting for some warping.

Base 34 may be a three-sided lattice structure that is weldable to work implement 12 (i.e., to first and second side walls 18, 20). Specifically, base 34 may have first and second rails 70, 72 that extend in a length direction, and a plurality of crossbars 74 that bridge rails 70, 72 to form recess 68. A raised load pad 75 may be formed at each corner of base 34 to transfer loading from body 38 of shroud 28 to side walls 18, 20 of work implement 12 (referring to FIG. 1). Load pads 75 may be integrally formed at intersections of rails 70, 72 with crossbars 74, and oriented at the sides of notches 62, 64. Internal surfaces of load pads 75 may be beveled to receive the dovetail shape of tabs 58, 60. In this way, notches 64 may provide sockets for receiving tabs 58, 60. Base 34 may he fabricated through a casting process from the same material as shroud 28 (or a more weldable material), and welded to work implement 12 along one or more outside edges of rails 70, 72. In some instances, an internal perimeter of one or more of cross-bars 74 (e.g., an internal perimeter of a weld pocket formed between cross-bars 74) may also be welded to work implement 12, if desired.

Retainer 36 may embody a generally flat rectangular locking mechanism, for example a type of spring clip, Which is configured to compress during installation and decompress thereafter. For example, one end of retainer 36 may be inserted through window 66 into recess 68, and then force may be applied at an opposing end to cause retainer 36 to compress somewhat. Once retainer 36 has been compressed, the opposing end may be pushed through window 66 into recess 68 and released, thereby allowing retainer 36 to decompress and expand back to its free length. When retainer 36 is fitted inside recess 68, retainer 36 may not be removed without first using a pry bar to compress retainer 36. In this condition, retainer 36 may protrude out of recess 68 to mechanically interfere with tab 58, thereby inhibiting shroud 28 from being unintentionally slid out of engagement with base 34.

INDUSTRIAL APPLICABILITY

The disclosed shroud and shroud assembly may be applicable to various earth-working machines, such as wheel loaders, skidsteer loaders, excavators, front shovels, and draglines. Specifically, the disclosed shroud may be used to protect curved work implements of these machines against wear. Installation of shroud assembly 32 will now be described.

To connect shroud assembly 32 to work implement 12 for the first time, shroud 28 may first be connected to base 34. In particular, tabs 58 and 60 may be aligned with notches 62 and 64, respectively, and shroud 28 pushed toward base 34 until tabs 58, 60 are fully engaged. Retainer 36 may then be placed through window 66 of shroud 28 and engaged with base 34. This assembly may then be placed at a desired location on work implement 12, and base 34 may be tack-welded. The desired location of shroud 28 may include a lower end of shroud 28 located adjacent floor 14 (referring to FIG. 1), with legs 40, 42 straddling edge 26.

Once base 34 is tack-welded, retainer 36 may be removed, and shroud 28 slide out of engagement with base 34. Base 34 may then be hilly welded into position. Thereafter, shroud 28 may be slid back into engagement with base 34 and retainer 36 reinserted. By allowing some variability in the mounting location of shroud assembly 32 on work implement 12, different configurations, sizes, shapes, and conditions of work implement 12 may be accommodated.

After initial installation of shroud assembly 32 on a particular work implement 12, shrouds 28 may be more easily installed, replaced, and/or reoriented, as desired. For example, after a period of use, when the lower ends of shrouds 28 are worn beyond a threshold amount, retainer 36 may be removed and shrouds 28 slid out of engagement with bases 34. Shrouds 28 may then be inverted and reinstalled on opposite sides of work implement 12 from where they were removed. The same or new retainers 36 may then be reinstalled.

It will be apparent to those skilled in the art that various modifications and variations can be made to the disclosed shroud. Other embodiments will be apparent to those skilled in the art from consideration of the specification and practice of the disclosed shroud. It is intended that the specification and examples be considered as exemplary only, with a true scope being indicated by the following claims and their equivalents.

What is claimed is:

1. A shroud assembly for a work implement having a floor and first curved side and a second curved side connected to the floor, the shroud assembly comprising:

a base weldable to an external surface of the first curved side;

a shroud having:

an elongated body being arcuate along its length, and having vertex and spaced apart first and second legs that are connected to the vertex;

a first protrusion extending inward at a first end of the elongated body;

a second protrusion extending inward at a second end of the elongated body; and a mounting portion extending from the first leg and having a window; and a locking mechanism configured to pass through the window of the mounting portion and engage the base, thereby locking the shroud to the first curved side of the work implement, wherein the mounting portion is formed from a back, a first side, and a second side;

the mounting portion includes at least one tab protruding inward from the back between the first and second sides; and the at least one tab is configured to slide into engagement with the base as the first and second legs of the elongated body are caused to straddle the first curved side of the work implement, and wherein the at least one tab includes:

a first tab located at a first end of the mounting portion proximate the first leg of the elongated body; and a second tab located at a second end of the mounting portion distal from the first leg of the elongated body.

2. The shroud assembly of claim 1, wherein the window is formed between the first and second tabs.

3. The shroud assembly of claim 1, wherein:

the first and second tabs are located at a center of the back, between the first and second sides of the mounting portion; and the base includes notches configured to receive the first and second tabs.

4. The shroud assembly of claim 3, wherein:

the locking mechanism is a spring clip compressible to pass through the window in the mounting portion and having an uncompressed length longer than a length of the window; and the locking mechanism creates an interference with the second tab after engagement of the locking portion with the base.

5. The shroud assembly of claim 1, wherein:

a ratio of a radius of the elongated body relative to a length of the elongated body is about 2.75-3;

the first and second protrusions extend from the vertex of the elongated body inward between the first and second legs; and a height of each of the first and second protrusions is about equal to 1/10th of a height of each of the first and second legs.

* * * * *